United States Patent [19]

Pawlaczyk

[11] 4,198,842

[45] Apr. 22, 1980

[54] HAND OPERATED TUBE CRIMPING APPARATUS

[76] Inventor: Ronald J. Pawlaczyk, 36511 Milo, New Baltimore, Mich. 48047

[21] Appl. No.: 902,170

[22] Filed: May 2, 1978

[51] Int. Cl.[2] ..... B21D 9/14

[52] U.S. Cl. ..... 72/307; 72/422

[58] Field of Search ..... 72/307, 383, 399, 369, 72/479, 422; 29/157 A

[56] References Cited

U.S. PATENT DOCUMENTS

| | | | |
|---|---|---|---|
| 343,631 | 6/1886 | Evans et al. | 72/383 |
| 1,160,326 | 11/1915 | Robertson | 72/307 |
| 2,593,732 | 4/1952 | Dahlman | 72/422 |
| 3,861,184 | 1/1975 | Knudson | 72/307 |

*Primary Examiner*—Michael J. Keenan

*Attorney, Agent, or Firm*—Burton, Parker & Schramm

[57] ABSTRACT

Described is a portable hand operable tube crimping device. The tube to be crimped is manually moved to the crimping die by means of a ratchet and pawl assembly connected to a drive means and the crimping die is manually operable by engaging a toggle assembly connecting a three piece male die set.

10 Claims, 14 Drawing Figures

62
58
54
60
56
64
66
68
42
90
92
94
96
2
20
22
24a
24b
26
28
29a
29b
40
70
72
73
74
146

FIG. 2
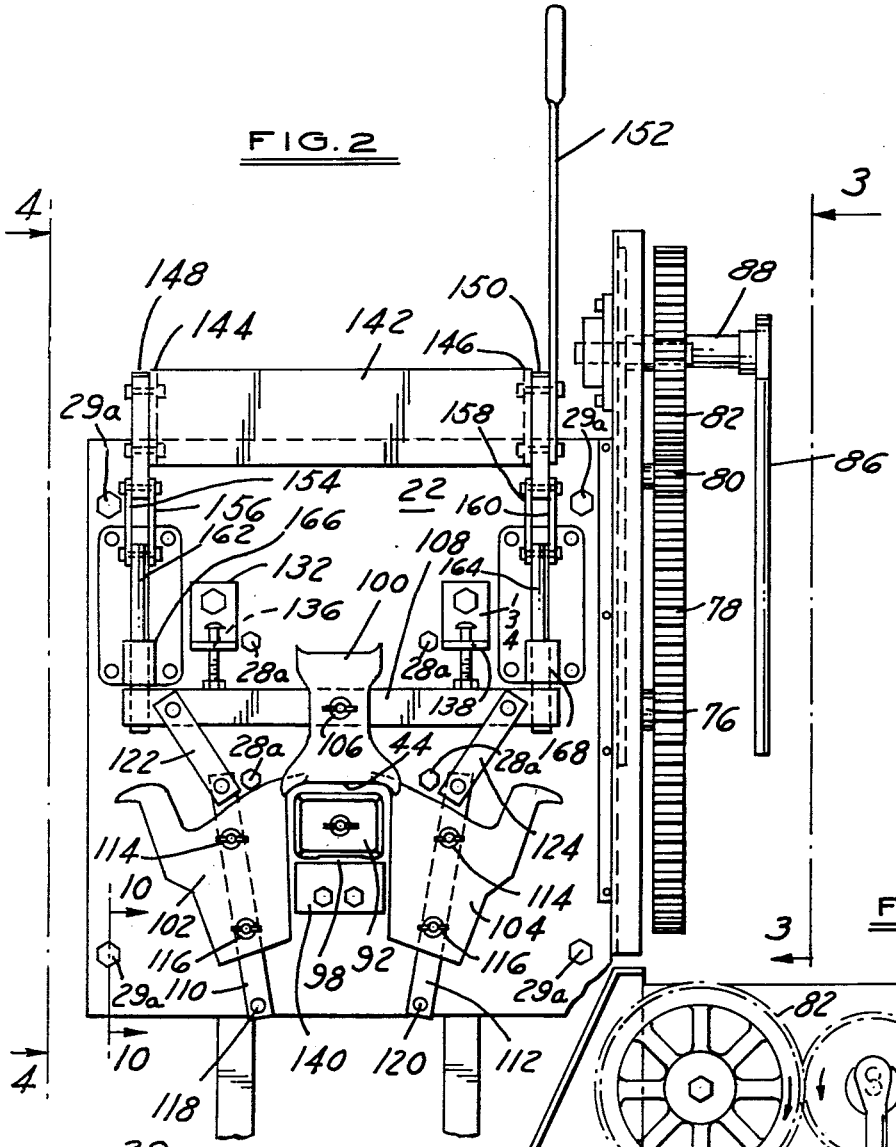
FIG. 3
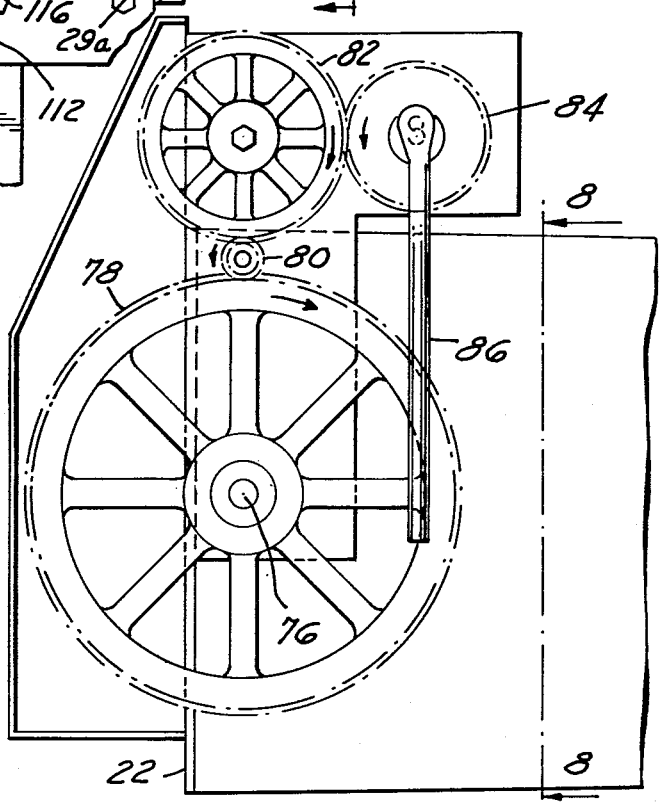
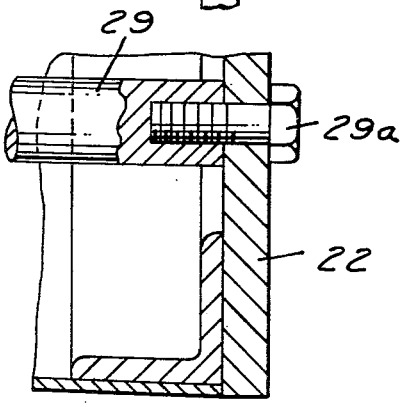
FIG. 10

HAND OPERATED TUBE CRIMPING APPARATUS

BACKGROUND OF THE INVENTION

The invention is concerned with forming crimps in a tube; more specifically, utilization of a hand operated portable tube crimping device.

U.S. Pat. No. 541,472 teaches a device for making crimped stovepipe elbows employing a driving shaft, eccentrics and a caming mechanism to impart the crimp to the pipe.

U.S. Pat. No. 706,030 teaches a metal crimping machine which employs a crimping mechanism and a creasing mechanism and a cam wheel geared to the power shaft within the machine frame so that the machine can operatively crimp and crease alternatively.

U.S. Pat. No. 748,686 teaches a pipe elbow machine performing in a series of automatic or mechanically directed movements the operation of forming inwardly extending eccentric creases in a pipe section.

U.S. Pat. No. 979,724 teaches a pipe bending machine which will be very rapid in its movement so as to provide a means for initially forming a rib before the crimped part is caused to overlap the body portion of the pipe or elbow.

U.S. Pat. No. 1,160,326 teaches an elbow forming machine employing a double-faced cam carried on a rotating shaft and adapted to engage portions on said mandrel to reciprocate the same.

U.S. Pat. No. 1,161,852 teaches an elbow machine which combines corrugated and crimping dies which are used for making longitudinal corrugated and transversely crimped elbows from straight sheet metal pipe sections.

U.S. Pat. No. 1,679,893 teaches a machine for making sheet metal pipe elbows wherein the folds of the crimp are not crushed flat in the initial operation of the machine but are first formed with slightly rounded bends and thereafter flattened completely by a partially drawing or smoothing operation.

U.S. Pat. No. 2,104,993 relates to a method and apparatus for making sheet metal elbows employing an automatic clamping mechanism for engaging the end of the tube and also employing a brake operation for automatically coordinating with the operation of a clutch to stop the machine instantly when the clutch is disengaged.

U.S. Pat. No. 3,670,553 teaches a tube bending machine which is adapted to crimp three sides of the tube by employing a toggle assembly and a pusher mechanism which are actuated simultaneously by a rotating cam connecting each assembly by rocker arms which reciprocate as the cam rotates.

U.S. Pat. No. 3,861,184 teaches a bending apparatus for forming elbows and the like by employing a stepping advance mechanism utilizing a star-like follower wheel and eccentric roller. A control is used to start the drive shafts and the control automatically stops when a selected number of crimps and step advances have been made.

All of the references discussed above do not relate towards a hand operable and a portable tube crimping device which can be used in the field by a workman. Much of the prior art is directly related to the highly automated technique for preparing elbows and the like for down spouts. The difficulty with many of these pieces of equipment is that they cannot be used to prepare down spouts having appropriate sized elbows for the particular configuration of the home or building on which the down spouts are being inserted. In addition, the devices taught do not form a length of tube which is of a defined length wherein a crimp has been placed anywhere along the length of said tube.

SUMMARY OF THE INVENTION

The present invention is concerned with a portable, hand operable tube crimping device comprising:

- a front plate;
- a back plate;
- an attachment means for connecting said front and back plate;
- a female die positioned on said front plate;
- a manually operable toggle mechanism means for movement of a male die which cooperatively engage the female die when in the engaged position; said toggle mechanism means positioned on said front plate;
- a drive means independently operated from said toggle means; said drive means providing transverse motion to the tube in the direction of the front plate whereby said tube can be crimped by engagement of the male and female die; and comprising a manually operable ratchet and pawl means.

The invention is also concerned with a method for crimping a tube employing a portable, manually operable machine comprising the steps;

1. Manually feeding a first end of a tube of defined length to said machine containing cooperatively engaging male and female die means; said male die means comprised of a toggle assembly;
2. Manually moving the first end of said tube to engage the female die;
3. Manually moving the male die means by moving the toggle assembly in a downward motion, thereby engaging the top and two sides of the tube by the male die means and forming one crimp at a time in the tube;
4. Applying a transverse motion to the second and opposite end of the tube in the direction of the first end of the tube, sufficient to move the crimp from the female die by manually operating a ratchet and pawl means; wherein the means for applying the transverse motion and the means for moving the male die means are manually operable means separate from each other;
5. Repeating steps 2–4 until the desired number of crimps are placed in the tube; and
6. Removing the crimped tube from the machine.

The ratchet and pawl means is operable, most preferably, by being connected by a chain to a ram or pusher means located adjacent the second and opposite end of the tube. Therefore, the tube may be pushed by the female die until the end thereof without forming additional crimps in the tube.

The present invention is primarily designed for manual operation on site where there is generally no readily available electric power means.

BRIEF DESCRIPTION OF THE DRAWINGS

FIG. 2 is a fragmentary front view taken along line 2—2 of FIG. 1.

FIG. 3 is a fragmentary side elevational view taken along line 3—3 of FIG. 2.

FIG. 10 is a fragmentary cross-sectional view of the front plate.

BRIEF DESCRIPTION OF PREFERRED EMBODIMENTS

Figures 1, 9:
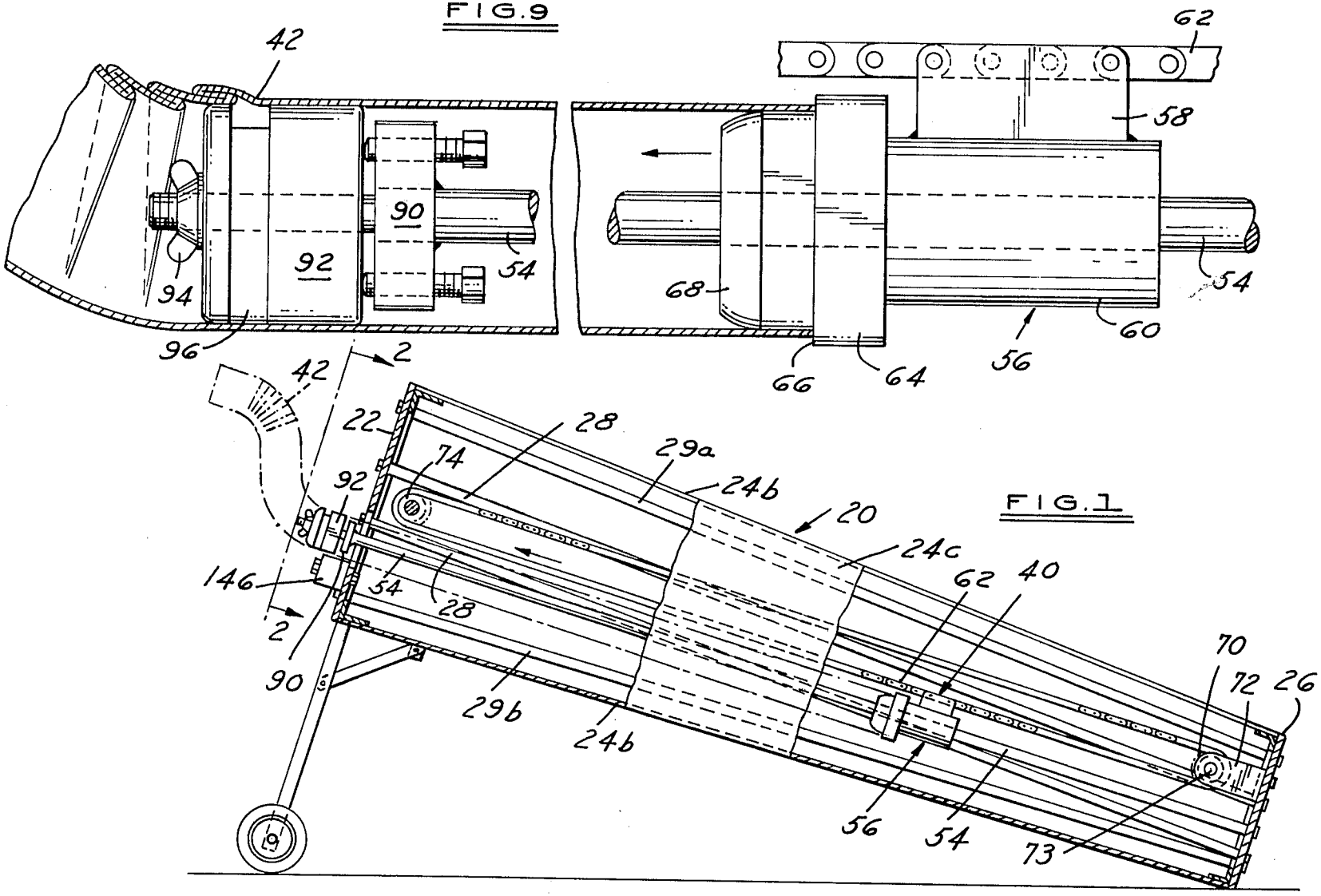
FIG. 1 is a plan view of the tube-bending machine.
FIG. 9 is a side elevational view of a tube having its crimps folded.
Figure 4:
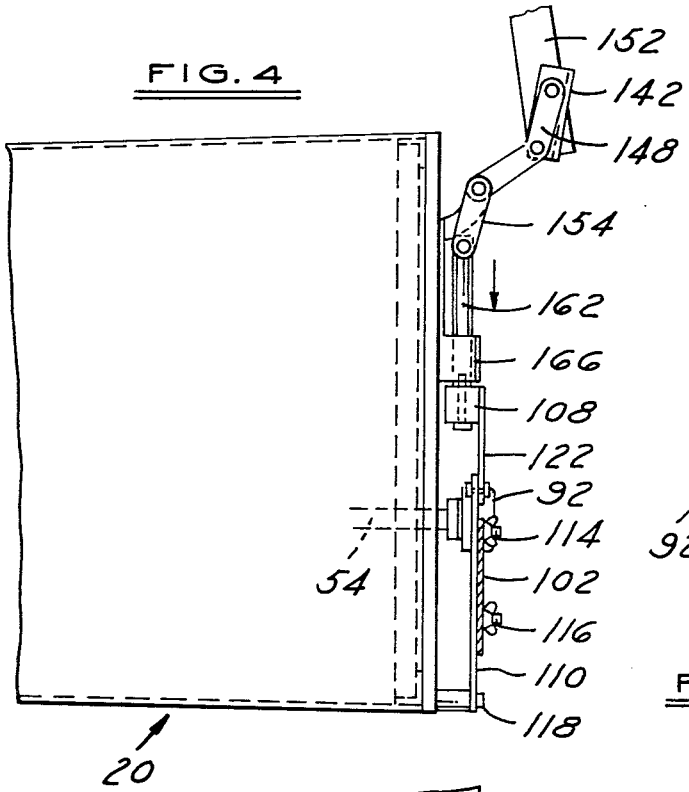
FIG. 4 is a side elevational view in cross-section taken along line 4—4 of FIG. 2.

Referring now to the drawings, FIG. 1 shows a tube bending machine for forming elbows in downspouts or the like having, in general, a housing designated at 20 comprising a front plate 22, side walls 24*a–d* and a back plate 26 forming a boxlike configuration and being interconnected by angle iron brackets for securing the plates and walls in their appropriate positions. The housing can be made of any hardened material, such as steel, aluminum, magnesium and alloys thereof, or the like, and can be secured to the angle iron brackets in any appropriate manner, such as by bolts, welds, or the like. Also symmetrically located about the central portions of the front and back plates and defining a boxlike configuration are stabilizer rods 28. Optionally, support bars 29 may secure the front plate 22 and the back plate 26. Each stabilizer and support bar is provided with interior threads in the end thereof for receiving a bolt 28*a* and 29*a* respectively for stabilizer and support rods. After the bolt is secured through its respective plate, one end of the stabilizer rods faces the rear of the front plate 22 and the other end faces the back plate 26. The connection of each bolt to the stabilizers is best viewed in FIG. 10, wherein the bolt can be screw-threadedly adjusted such that the stabilizers vary the distance between the front and back plates. The stabilizers also retain the face plate 22 in a position such that the drive mechanism behind the face plate, to be later described, is appropriately aligned with the face plate.

To assist in making the tube bending machine portable, I have provided a pair of wheels secured to a pair of legs, only one of which is visible in FIG. 1, and have secured the said legs to the forward portion of the tube bending machine, preferably through one of the angle iron brackets giving the legs more support. A central shaft is also provided which separates the wheels and retains them in a uniformly spaced apart condition for balancing the weight of the machine equally on each wheel.

Referring to FIGS. 1 and 2 there is shown a tube bending machine having a front plate 22 with male upper 100 and side die 102, 104 assemblies thereon and an inner female die assembly 92 therethrough for crimping the corrugated blank tube 42 of a downspout as it is propelled about the inner die assembly.

The drive mechanism 40 for propelling the tubular blank of the downspout is slidably mounted for fore and aft movement of the spout within housing 20 on center rod 54, said rod extending from back plate 26 to front plate 22 and is secured to back plate 26 in a manner similar to that described for FIG. 10. The drive mechanism 40 comprises a push block 56 and having a bracket 58 mounted to a sleeve 60 and secured for driving movement to the driving chain 62; a collar 64 providing a shoulder 66 against which the end of the tube blank rests, and a mandrel 68 receiving the interior of the blank for holding the blank against transverse movement from the shoulder. Mandrel 68 also retains the tube blank 42 in an appropriate position for crimping, such that the blank will not inadvertently bend while being driven forward across the inner die. The chain secured to the bracket 58 is also secured to sprockets at the front and the end of the tube bending machine. The end sprocket 70 is secured to the legs of a U-shaped bracket 72 by a shaft 73 freely rotatable in the U-shaped bracket about the axis of the shaft. The central portion of the U-shaped bracket is secured by a bolt through the back plate 26, said bolt being adjustable for adjusting longitudinal tension to the chain. In addition, the bolt assembly securing the U-shaped bracket to the back plate could be loosely retained in the back plate such that the bracket is rotatable about the axis of the bolt assembly thereby permitting the chain to self-align itself in response to stresses applied to the chain.

Figure 8:
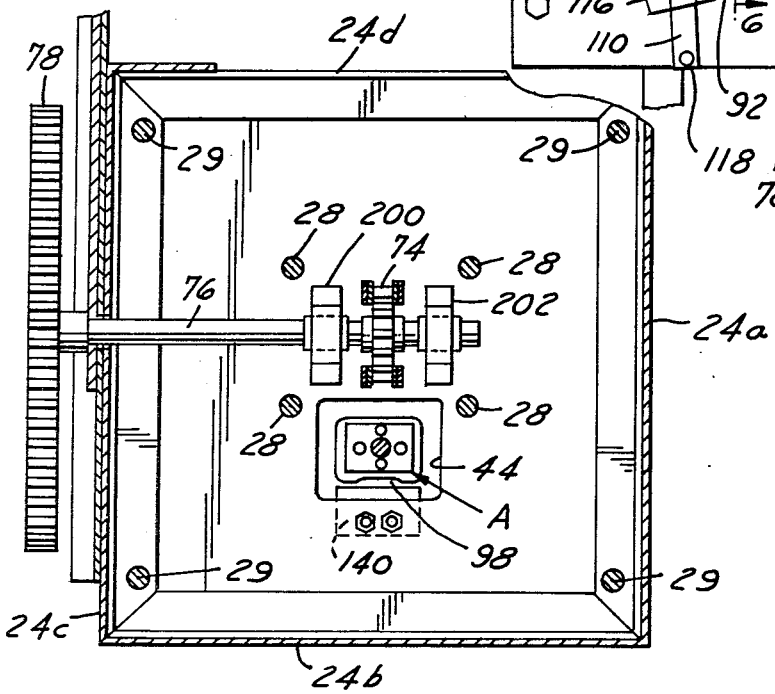
FIG. 8 is a fragmentary end view of the reverse side of the front plate.

The chain is secured to a front sprocket 74 located adjacent the rear of the front plate generally in a manner common to the art. The sprocket is integrally secured to a connecting shaft 76, said shaft being secured to the rear of the front plate by depending bearing housings 200, 202. The bearing housings locate the sprocket substantially midway the width of the front plate and just above the opening in the front plate through which the blank extends during the crimping sequence as best seen in FIG. 8. The connecting shaft 76 extends longitudinally outwardly to a first gear 78 as seen in FIGS. 8 and 3. The first gear 78 is positively meshed with a series of gears and comprises propelling means to the sprocket. One of the objects of the series of gears is to minimize the force required by the machine operator to drive the blank across the inner die assembly. Accordingly, gears 80, 82, and 84 are also provided for driving the first gear. Attached to the last gear 84 is a ratchet type handle 86 having a ratchet type mechanism such that the handle can be rotated a certain angular distance before rotating the handle back in an opposite direction to an initiating position where the ratchet is reset. Using the construction shown in FIGS. 3 and 8 to positively drive the blank forward over the inner die, the operation of which will be presently described, the ratchet handle 80 will be positively rotated in a counterclockwise direction, thereby rotating extension 88 and last gear 84 in a counterclockwise direction and rotating gear 82 in a clockwise direction and gear 80 in a counterclockwise direction. First gear 78 will then be rotated in a clockwise direction thereby rotating shaft 76 and front sprocket 74 in a clockwise direction, which in turn will force drive mechanism 40 in a forward direction pushing the blank 42 through opening 44 and across inner female die 92. To reset the ratchet, the ratchet can be rotated in the opposite direction, each clockwise rotation of the handle resetting the ratchet for positive forward movement in a counterclockwise direction. If reverse movement of the ratchet is desired, a small lever on the side of the ratchet may be engaged to an alternative condition such that the ratchet will positively drive in a clockwise direction and rest in a counterclockwise direction.

The inner female die assembly A is fixedly supported on center rod 54, the center rod being mounted at its remote end to the back plate 26 and extending through the drive mechanism 40 as previously explained. At its front end the center rod 54 supports a die adjusting plate 90 secured to the center rod perpendicular to the longitudinal axis of the rod. A plurality of bolts extend through the adjusting plate 90 for adjusting the location of the inner forming die 92. The inner forming die 92 is secured to a reduced portion of the center rod 54 by a wing nut 94 which fastens the forming die against the adjusting bolts. The forming die is generally rectangular in shape as best viewed in FIGS. 6 and 7. An annular groove 96 is formed on three sides of the die for receiving the blades of the male outer die assembly. The corners forming the annular groove are generally steeply inclined inward. However, the peripheral edges of the inner die are rounded so as to protect the fabric of the blank. On the bottom of the die, on the surface not having a groove therein, there is provided a channel 98, said channel relieving the pressure on the blank when the blank is being crimped.

The male die assembly comprises an upper blade or die 100 located above the blank opening 44 and two symmetrically arranged side male dies 102, 104 each disposed on opposite sides of the opening. The upper die 100 is removably fastened by wing nut 106 on an upper die holder 108 reciprocated by the toggle mechanisms. The upper die is constructed such that end-to-end reversal of the die will realign an alternative type of die to be used for crimping the blank.

Side dies 102, 104 are removably mounted to die holders 110, 112 by two wing nuts 114, 116. Each side die holder 110, 112 is pivoted adjacent the base of the face plate by a pivot 118, 120 and is likewise pivoted to a side arm 122, 124. The side arms 122, 124 are pivoted to the upper die holder at their opposite ends as best viewed in FIG. 2. The alternative type of die can be obtained by reversing the side dies and resecuring them to the side die holders.

It is evident from FIG. 2 that as the upper die holder 108 is forced downward by the toggle mechanisms, the side arms will likewise be pivoted inward toward the inner die assembly, with the upper portion of the side dies being urged closer to the inner die than the lower portion of the side dies and consequently giving a tapering effect to the indentation made by the side dies in the tube blank 42. In addition, and as best viewed in FIG. 6, it will be noted that the upper die 100 has a steeply inclined surface 126 directed inwardly. Although not shown, male side dies 102, 104 likewise have inclined surfaces. The inclined surfaces are provided to protect the fabric of the blank from damage when the die is crimping the blank.

For adjusting the downward stroke of the upper die holder 108, thereby adjusting the inward thrust of the dies, I have provided L-shaped brackets 132, 134 secured above the upper die holder to the face plate and each having a hole 136, 138 within their respective outwardly extending leg and a bolt extending therethrough, said bolt being threadedly secured to the upper die holder such that adjustment of the bolts and therefore their vertical height from the upper die holder determines downward movement of the upper die holder. Limiting downward travel of the upper die holder likewise limits the depression of the upper and side dies in blank 42.

A lower die block 140 is removably fastened on the front plate by a pair of bolt fasteners. The die block 140 supports the blank 42 primarily when the blank is being crimped. The block is preferably made of a synthetic inflexible material, the material avoiding damage to the back side of the elbow.

To activate the dies by driving the upper die holder, there is provided a toggle mechanism comprising a pair of toggle members interconnected by a connecting plate 142. The connecting plate 142 is provided with a pair of depending legs 144, 146, each leg being bolted to an S-shaped bracket 148, 150 defining each toggle member. S-shaped brackets 148, 150 are pivoted to the face plate such that they extend perpendicularly outward from the face plate. The opposite end of S-shaped brackets are attached to the connecting plate 142 and bracket 148 is also connected to a handle 152, said handle permitting rotation of S-shaped brackets for driving the upper die holder 108 downward. The middle portion of either S-shaped bracket 148 or 150 is secured to a pair of links 154, 156 and 158, 160, each link secured to the opposite side of the S-shaped bracket. Each link is then secured at its lower end to a toggle plunger 162, 164 sliding in a sleeve 166, 168 secured to plate 22. Each plunger is secured to the upper die holder 108 such that the die holder is urged downward when the plungers are forced downward.

Figure 6:
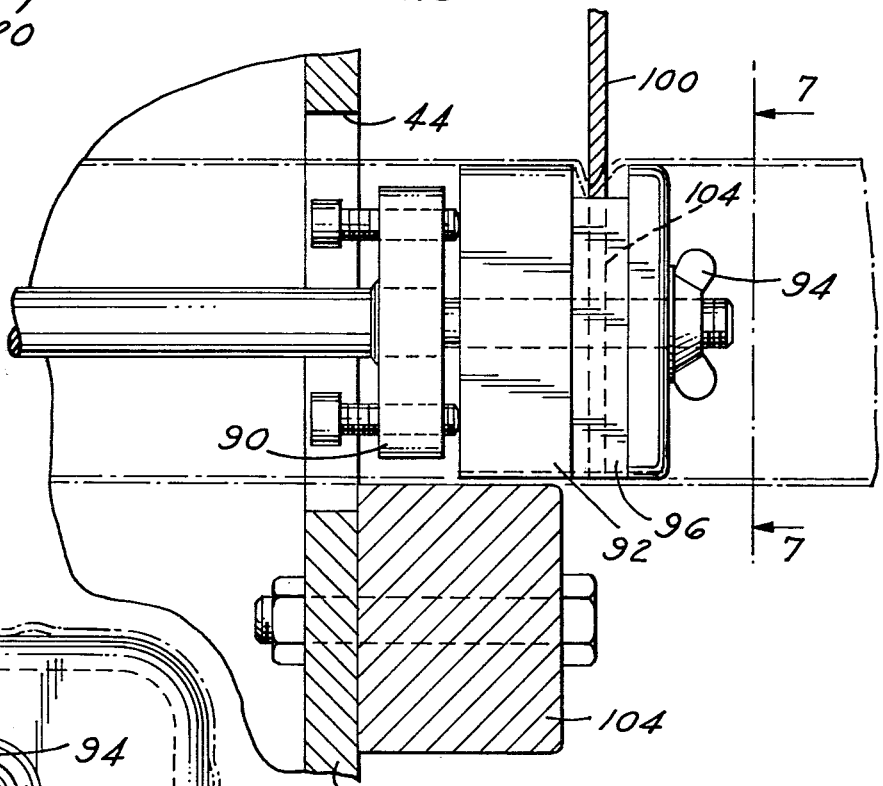
FIG. 6 is a side elevational view of a tube being crimped by the machine.
Figure 7:
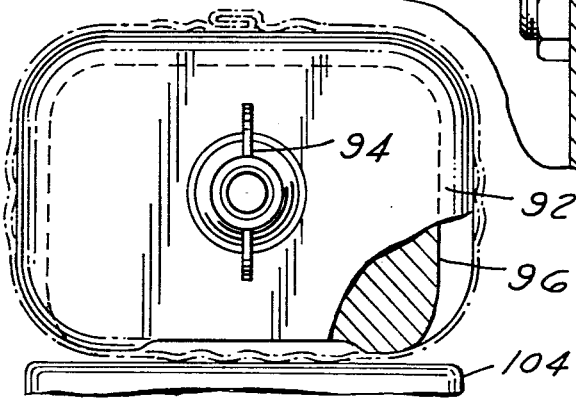
FIG. 7 is a front elevational view taken along line 7—7 of FIG. 6.
Figure 5:
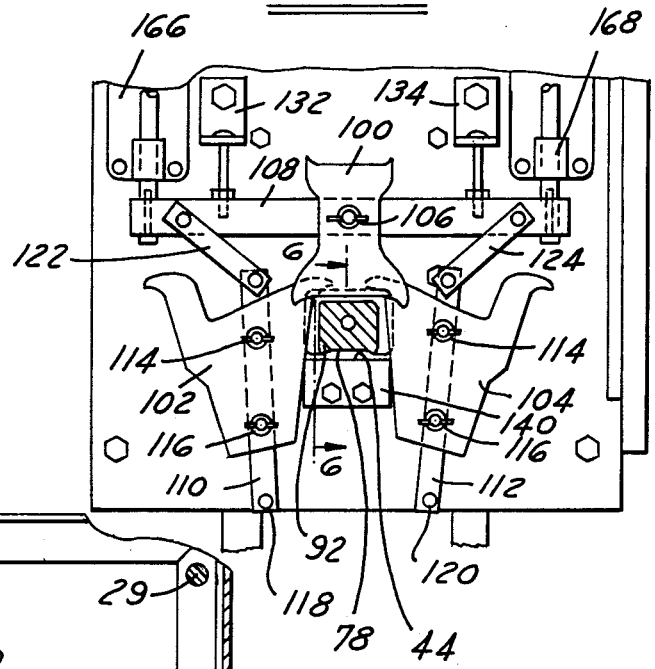
FIG. 5 is a fragmentary front view of the crimping step by the machine.

In operation, and as best viewed in FIGS. 5 and 6, the handle 152 is rotated toward the operator as the operator faces the front of face plate 22. Rotation of the handle also rotates the S-shaped brackets 148, 150 toward the operator thereby driving their respective links downward. Accordingly, plungers 162, 164 are also driven downward forcing upper die holder 108 downward. Downward movement of the upper die holder likewise moves the side dies inward to complete the indenting portion of the crimping procedure. As seen in FIG. 9, the blank is then urged forward across the inner die assembly by the push block assembly being forced forward by the operator rotating the ratchet handle 86 counterclockwise. The indentation made by the outer male die assembly is forced across the forward lip of the annular groove on the inner die. The fabric of the blank when being forced forward will be urged rearwardly and then upwardly as the fabric crosses the lip of the inner die. It is believed a pressure of about 2000 pounds or more is needed to move the crimped tube across the lip of the female die.

Figure 12:
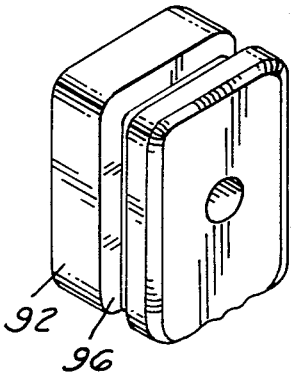
FIG. 12 is a perspective view of the female die for the alternative embodiment.
Figure 11:
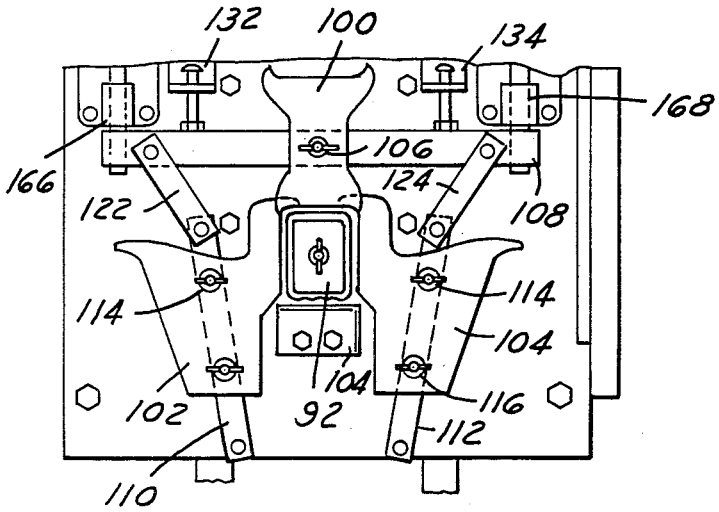
FIG. 11 is a fragmentary front view similar to FIG. 2 and using an alternative embodiment.

The machine is adapted to produce elbows in blanks about either their major or minor axis and the change of set-up may be a simple replacement of the dies and associated fasteners. When it is desired to bend the blank 42 with its minor axis horizontal as opposed to vertical, the procedure is as follows. See FIGS. 11 and 12. The inner die is removed from the center rod and the outer die are removed from their respective die holders. The inner die is then attached to the center rod and properly aligned using the adjusting plates and adjusting bolts. The outer dies are rotated 180° and replaced using the same wing nuts. Thus the fasteners and die remain identical, but are merely shifted to various positions appropriate to the construction of the blank. The mandrel is aligned with the end of the blank by adjustably positioning the push block with the propelling mechanism.

It should be noted that the length of the machine could approximate six feet and that at least two elbows could be placed in a section of spout, the radius of each elbow being dependent on the number of crimps in the spout. It should be appreciated that a distinct advantage of the present invention is that should two elbows be placed in a tube, one can retain the crimps in a downwardly facing position, thereby avoiding dirt and silt being retained in upwardly facing crimps.

The bending operation can be best understood by reference to FIGS. 1, 2 and 6 and is begun by insertion of a length of straight spout over the inner die and through the opening until the end of the blank abuts the shoulder of the push block. As the toggle assembly is actuated, the outer male die assembly moves inwardly to crimp the walls of the blank which are engaged, generally forcing the blank into the annular groove of the inner female die. The operation of this crimping force to only three walls, two being tapered, forces the blank to be turned upward. Once the outer dies are removed, the driving mechanism can be actuated for completing the crimp in the blank by forcing the crimp across the lip of the inner die. This action not only completes the crimp, but also relocates the blank for further crimping. It should be understood that the greater the number of crimps placed in the blank, the greater will be the angle the blank is bent. In addition, the depth of each bite of the outer die can be adjusted so that a particular number of bites at a certain depth will produce various types of angles.

Figure 13:
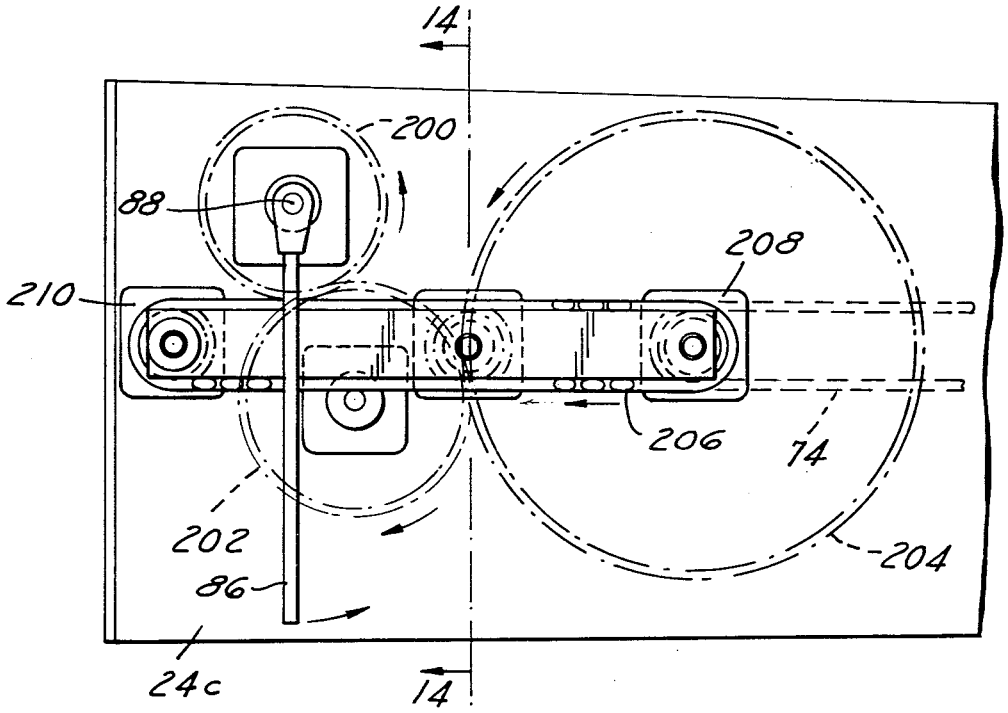
FIG. 13 is a side fragmentary view of an alternative embodiment of the present invention.
Figure 14:
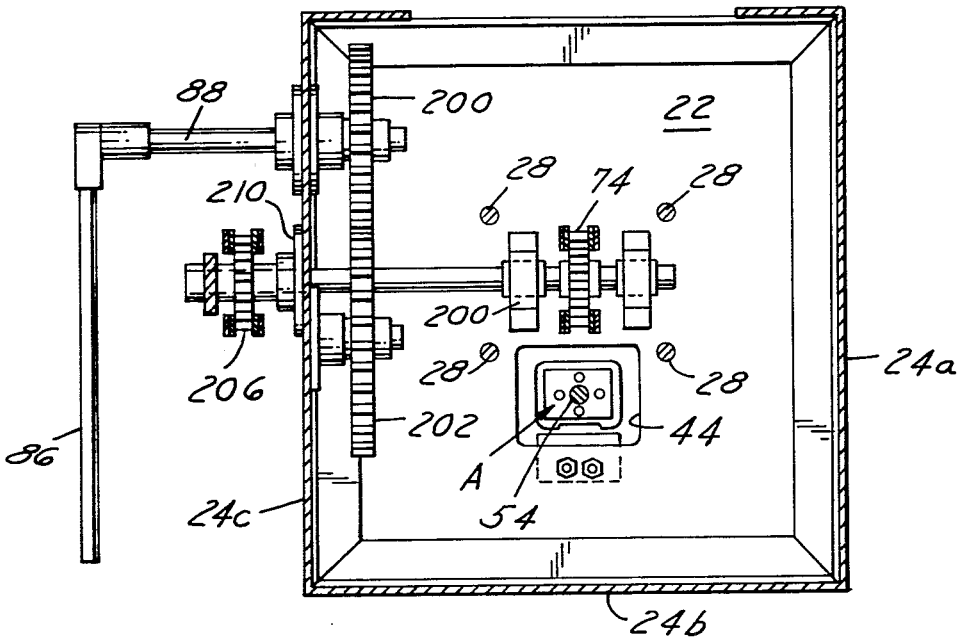
FIG. 14 is a fragmentary view of the back side of the alternative embodiment taken along lines 14—14.

FIGS. 13 and 14 are alternative embodiments of the present invention whereby all of the gears are installed within the protective side wall 24*a–d*. The handle 86 rotates in a counterclockwise motion thereby turning gear 200 in a counterclockwise motion which in turn rotates a second gear 202 in a clockwise motion and it in turn rotates a third gear 204 in a counterclockwise motion, shown by the arrows in FIG. 13.

On the outside of the side wall is a chain 206 engaging first and second sprockets 208, 210, respectively. The tube bending machine of FIGS. 13 and 14 operates substantially similar to that described above. As the first gear 208 rotates by movement of the handle, the pusher means attached to the interior chain moves the tube through the die assembly. By utilizing protective walls 24*a–d*, only stabilizer rods 28 need be used.

A distinct safety advantage of either embodiment of the present application is that the operator can have two hands operating the equipment, the first hand can rotate handle 86 while the second operates handle 152, so as not to have hands caught in die assembly.

What is claimed is:

1. A portable, hand operable tube crimping device comprising;

a front plate;

a back plate;

an attachment means for connecting said front and back plate;

a female die positioned on said front plate;

a manually operated toggle mechanism means for movement of a male die which cooperatively engages the female die when in the engaged position so to indent a tube inserted therebetween; said toggle mechanism means positioned on said front plate; and a manually operated drive means independently operated from said toggle means; said drive means (a) providing transverse motion to the tube in the direction of the front plate (b) comprising a manually operable ratchet and pawl means and (c) being capable of developing sufficient power to drive the indented tube across a portion of the female die and thereby flatten the indentation.

2. The device of claim 1 wherein the drive means is comprised of a pusher means abutting the opposite end of the tube for providing the transverse motion by engagement of the ratchet and pawl means connected to the pusher means by a chain.

3. The device of claim 1 wherein the male die means is comprised of three pieces, each having two sides capable of engaging different configurations of the female die.

4. The device of claim 1 mounted on wheels.

5. The device of claim 1 wherein the attachment means comprise stabilizers which align the front plate with the drive means.

6. The device of claim 5 wherein the stabilizers are adjustable so that the distance between the front and back plates may be varied.

7. The device of claim 1 wherein the female die has an annular groove into which the indentation is made, the outer lip of said groove being the portion of the female die over which the indentation is driven to flatten it.

8. A method of crimping a tube employing a portable, manually operable machine comprising the steps;

a. manually feeding a first end of a tube of defined length into said machine containing cooperatively engaging male and female die means where said tube overlies the female die means and said male die means comprised of a toggle assembly;

b. manually moving the male die means by moving the toggle assembly in a downward motion, thereby engaging the top and two sides of the tube by the male die means and forming an indentation in the tube;

c. moving the first end of the tube toward the female die with sufficient power so to drive the indentation over a portion of the female die so to flatten the indentation and thereby complete the crimp by means of manual drive comprising ratchet and pawl means, wherein the manual drive means and the means for moving the male die means are manually operable means separate from each other;

d. repeating steps of b and c until the desired number of crimps are placed in the tube; and e. removing the crimped tube from the machine.

9. The method of claim 8 wherein the drive means further comprises a pusher means abutting the first end of the tube are connected to the ratchet and pawl means by a chain.

10. The method of claim 8 wherein the female die has an outer lip which is the portion over which the indentation is driven to flatten it.

* * * * *

UNITED STATES PATENT AND TRADEMARK OFFICE

CERTIFICATE OF CORRECTION

PATENT NO. : 4,198,842

DATED : April 22, 1980

INVENTOR(S) : Ronald J. Pawlaczyk

It is certified that error appears in the above—identified patent and that said Letters Patent is hereby corrected as shown below:

Column 8, line 57 (claim 9) "are" should read -- and --.

Signed and Sealed this

*Thirtieth* Day of *September 198(*

[SEAL]

*Attest:*

SIDNEY A. DIAMOND

*Attesting Officer*

*Commissioner of Patents and Trademark*